US009860014B2

(12) United States Patent
Mead Gill et al.

(10) Patent No.: US 9,860,014 B2
(45) Date of Patent: Jan. 2, 2018

(54) SYSTEM AND METHOD FOR JAMMING CELLULAR SIGNALS USING AERIAL VEHICLES

(71) Applicant: The Boeing Company, Chicago, IL (US)

(72) Inventors: Margaret A. Mead Gill, Seattle, WA (US); Sean P. Gill, Seattle, WA (US)

(73) Assignee: THE BOEING COMPANY, Chicago, IL (US)

( * ) Notice: Subject to any disclaimer, the term of this patent is extended or adjusted under 35 U.S.C. 154(b) by 91 days.

(21) Appl. No.: 14/501,348

(22) Filed: Sep. 30, 2014

(65) Prior Publication Data

US 2016/0094309 A1 Mar. 31, 2016

(51) Int. Cl.
*H04K 3/00* (2006.01)
*H04K 1/10* (2006.01)

(52) U.S. Cl.
CPC ..... *H04K 3/60* (2013.01); *H04K 3/00* (2013.01); *H04K 3/80* (2013.01); *H04K 2203/16* (2013.01); *H04K 2203/22* (2013.01); *H04K 2203/34* (2013.01)

(58) Field of Classification Search
CPC .. H04K 3/00; H04K 3/45; H04K 3/42; H04K 3/92; H04K 3/43; H04K 3/415; H04K 2203/18; H04K 2203/22; H04K 2203/23; H04K 2203/24; H04K 2203/34
See application file for complete search history.

(56) References Cited

U.S. PATENT DOCUMENTS

2003/0095067 A1* 5/2003 Howell ..... H01Q 3/26 342/377
2011/0275308 A1* 11/2011 Grobert ..... G01S 19/04 455/1
2012/0178358 A1* 7/2012 Haverty ..... H04K 3/28 455/1

OTHER PUBLICATIONS

NPL Breheny et al, Using Airborne Vehicle-Based Antenna Arrays to improve communications with UAV clusters, Dec. 2003.*
NPL-Boeing New Air Traffic Surveillance technology ADS-B, Boeing, Apr. 22, 2010.*

* cited by examiner

*Primary Examiner* — Wesley Kim
*Assistant Examiner* — Dong-Chang Shiue
(74) *Attorney, Agent, or Firm* — Patterson + Sheridan, LLP

(57) ABSTRACT

A system and method for jamming cellular signals using aerial vehicles is provided. In a preferred embodiment, the aerial vehicles are unmanned aerial vehicles. A plurality of aerial vehicles are coordinated together to send signals to a predetermined area to jam the cellular network.

20 Claims, 1 Drawing Sheet

SYSTEM AND METHOD FOR JAMMING CELLULAR SIGNALS USING AERIAL VEHICLES

FIELD OF THE INVENTION

Embodiments of the present disclosure relate generally to a system and method for jamming cellular networks using a plurality of aerial vehicles.

BACKGROUND OF THE INVENTION

Road side bombs are often denoted using a cellular signal. Prior art cellular jamming has been accomplished using a ground vehicle which is specially designed for such use. The ground vehicle accompanies a convoy to protect the convoy as it travels down a path, such as a road or over terrain. The ground vehicle is large, slow moving, expensive to produce, and looks different than the other vehicles in the convoy. As such, the ground vehicle used for jamming cellular signals is subject to attack.

SUMMARY OF THE INVENTION

A system and method for jamming cellular signals using aerial vehicles is provided. In a preferred embodiment, the aerial vehicles are unmanned aerial vehicles. A plurality of aerial vehicles are coordinated together to send signals to a predetermined area to jam the cellular network.

The scope of the present invention is defined solely by the appended claims and is not affected by the statements within this summary.

BRIEF DESCRIPTION THE DRAWINGS

The invention can be better understood with reference to the following drawings and description. The components in the figures are not necessarily to scale, emphasis instead being placed upon illustrating the principles of the invention.

Figure 1:
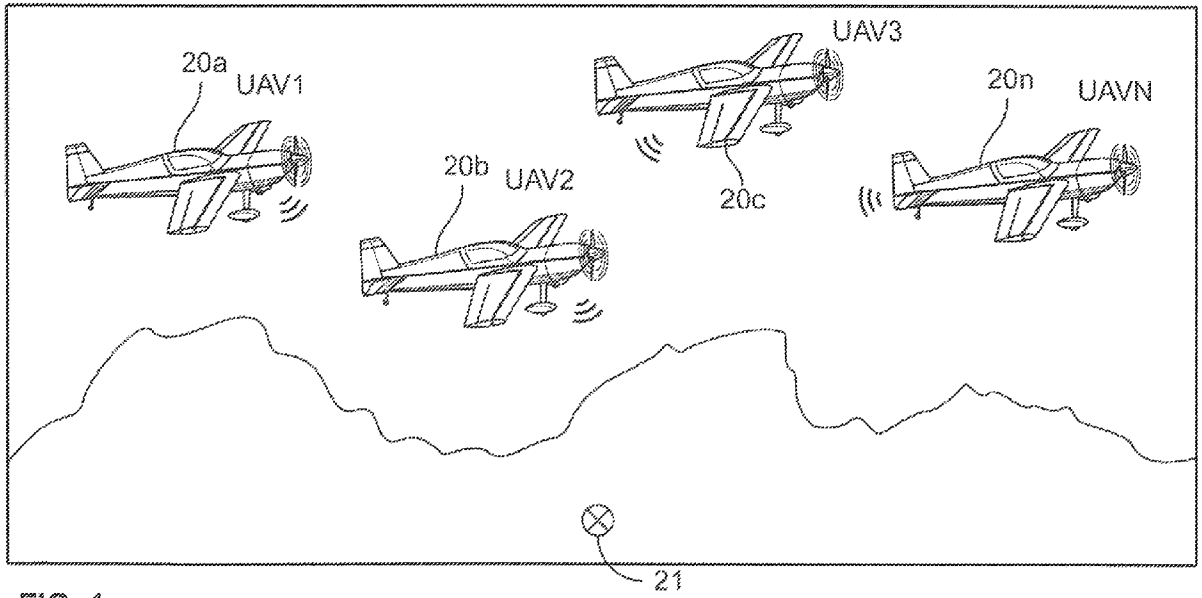
Figure 2:
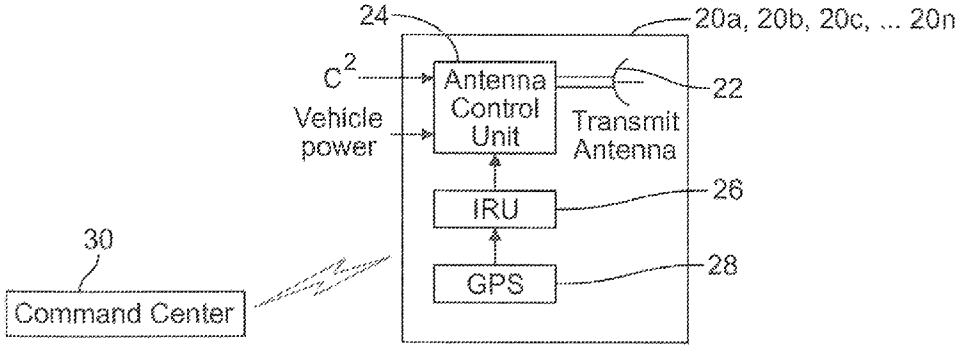

FIG. 1 is a representational view of a system which incorporates the features of the present invention; and FIG. 2 is a block diagram of the system architecture.

DETAILED DESCRIPTION

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein. Therefore, unless otherwise noted, features disclosed herein may be combined together to form additional combinations that were not otherwise shown for purposes of brevity. The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. Furthermore, there is no intention to be bound by any expressed or implied theory presented in the preceding field, background, summary or the following detailed description. The present disclosure should be accorded scope consistent with the claims, and not limited to the examples described and shown herein.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

A plurality of aerial vehicles 20*a*, 20*b*, 20*c* . . . 20*n*, preferably unmanned aerial vehicles (UAVs), are used to send coordinated signals, which are all in the same phase, to jam a cellular network at a ground based target 21. Manned aerial vehicles may also be used. The aerial vehicles 20*a*, 20*b*, 20*c* . . . 20*n* are coordinated to create an active phased array to jam the cellular signal within the ground based target 21. In antenna theory, a phased array is an array of antennas in which the relative phases of the respective signals feeding the antennas are varied in such a way that the effective radiation pattern of the array is reinforced in a desired direction and suppressed in undesired directions. The ground based target 21 is a determined area, and may be the position of a land based vehicle or vehicles in a convoy traveling down a path, such as a road or over terrain. The position of the convoy is known and this present system and method can be used to protect a particular land based vehicle, by pinpointing the specific latitude, longitude and altitude location of the land based vehicle and then transmitting an in-phase signal at the same time from each of the aerial vehicles 20*a*, 20*b*, 20*c* . . . 20*n*.

Aerial vehicles 20*a*, 20*b*, 20*c* . . . 20*n* such as those used in the present system and method are known in the prior art, and include a directional antenna 22 mounted the aerial vehicle 20*a*, 20*b*, 20*c* . . . 20*n* for transmitting signals to as specific location. For jamming a cellular signal, an ultra-high frequency (UHF) antenna is used. As shown in FIG. 2, aerial vehicles 20*a*, 20*b*, 20*c* . . . 20*n* also include an on-board antenna control unit 24 having a microprocessor, a transceiver and software, an onboard Inertial Reference Unit (IRU) 26 (sometimes called an INU (Inertial Navigation Unit), and the term IRU used herein encompasses both) which is in communication with the antenna control unit 24, and an onboard Global Positioning Unit (GPS) 28 which is in communication with the IRU 26. The antenna 22 is communication with the antenna control unit 24. As is known in the art, the IRU 26 is a type of inertial sensor which uses gyroscopes and accelerometers to determine a moving vehicle change in rotational altitude and translational position over a period of time. When the information from the IRU 26 is combined with the information from the GPS 28, the antenna control unit 24 can determine the precise location and attitude of the aerial vehicle. The gyroscope indicates if the aerial vehicle 20*a*, 20*b*, 20*c* . . . 20*n* is rotating at all, that is whether the roll, pitch and yaw of the aerial vehicle 20*a*, 20*b*, 20*c* . . . 20*n* is changing. The accelerometer provides information regarding the speed of the aerial vehicle 20*a*, 20*b*, 20*c* . . . 20*n* and in which direction the aerial vehicle 20*a*, 20*b*, 20*c* . . . 20*n* is accelerating or decelerating. That is, the antenna control unit 24 can determine the precise latitude, longitude, altitude of the aircraft, and can determine the precise attitude, namely the roll, pitch and yaw positions of the aircraft. This determination is extremely precise.

UHF frequencies range from about 300 MHz to about 3 GHz, with specifically 1.9 GHz being an approximate frequency used internationally for cellular. At 1.9 GHz, a single wavelength is approximately 6.2 inches. In order for the phase amplitudes to align from the multiple aerial vehicles 20*a*, 20*b*, 20*c* . . . 20*n*, a command center 30 needs to know the latitude, longitude and altitude of each aerial vehicle 20*a*, 20*b*, 20*c* . . . 20*n* within 1/50 of a wavelength, or 0.124 inches. This is accomplished by the onboard IRU 26.

As is also known in the prior art, inputs to the antenna control unit 24 include vehicle power, to operate the antenna control unit 24, and a command and control signal C2 which receives and sends information regarding the aerial vehicle 20*a*, 20*b*, 20*c* . . . 20*n* to a command center 30 which is remote from the aerial vehicles 20*a*, 20*b*, 20*c* . . . 20*n*. The signals are sent between the antenna control unit 24 and the command center 30 via wireless means as is known in the art. A command and control signal C2 is sent from the command center 30 to each antenna control unit 24 to operate the aerial vehicles 20*a*, 20*b*, 20*c* . . . 20*n*. The command center 30 may be ground-based or aerial based, and may be at a great distance from the aerial vehicles 20*a*, 20*b*, 20*c* . . . 20*n*. For example, the aerial vehicles 20*a*, 20*b*, 20*c* . . . 20*n* may be operating in the Middle East, and the command center 30 is located in the United States. The command and control signal C2 conveys information to the antenna control unit 24 on each aerial vehicle 20*a*, 20*b*, 20*c* . . . 20*n* regarding the ground based target 21, namely the latitude and longitude positions that each antenna 22 needs to send a signal. In addition, the command and control signal C2 conveys information regarding the phase at which each antenna 22 needs to send a signal to the ground based target 21. The combination of this pieces of information enable each antenna 22 to transmit a signal at the correct latitude and longitude location and at the appropriate phase to correctly make a quality jamming signal within the ground based target 21.

In use, the multiple aerial vehicles 20*a*, 20*b*, 20*c* . . . 20*n* form an active phased array. With the present system and method, the signals from multiple aerial vehicles 20*a*, 20*b*, 20*c* . . . 20*n* from different locations and different altitudes are added together to form the phased array. These multiple aerial vehicles 20*a*, 20*b*, 20*c* . . . 20*n* may be hundreds of feet apart, or even approximately a mile apart.

With this system, each aerial vehicle 20*a*, 20*b*, 20*c* . . . 20*n* is treated as a unique antenna element. In order to create the phased array, the present method builds upon the Robert J. Mailloux equation for two-dimensional scanning of planar arrays, namely:

$$F(\theta,\varphi)=\{\Sigma b_m \exp[jk_o m d_x(u-u_o)]\}\{\Sigma c_m \exp[jk_o n d_y(v-v_o)]\}$$

With the present method, altitude is added to the Robert J. Mailbox equation above to transition to two-dimensional scanning of non-planar arrays F(θ, φ, $\tilde{\mathfrak{J}}$) to obtain the following equation:

$$F(\theta,\varphi)=\{\Sigma b_m \exp[jk_o m d_x(u-u_o)]\}\{\Sigma c_n \exp[jk_o n d_y(v-v_o)]\}\{\Sigma d_p \exp[jk_o p d_g(w-w_o)]\}$$

This provides the information necessary to determine which phase in which each aerial vehicle 20*a*, 20*b*, 20*c* . . . 20*n* needs to transmit its signal to hit the ground based target 21. The signals sent from the aerial vehicles 20*a*, 20*b*, 20*c* . . . 20*n* are added together within the ground based target 21 to overpower any cellular signal within the ground based target 21, for example, to jam any cellular signal instated in an attempt to detonate a roadside bomb.

In each aerial vehicle 20*a*, 20*b*, 20*c* . . . 20*n*, the IRU 26 uses gyroscopes and with the information from the GPS 28, the antenna control unit 24 can precisely determine the position and attitude of the respective aerial vehicle 20*a*, 20*b*, 20*c* . . . 20*n*. This allows the command center 30 to know which phase the different aerial vehicles 20*a*, 20*b*, 20*c* . . . 20*n* need to operate at in order to be able to simultaneously hit the ground based target 21 with the correct phase and also how to direct the attitude of the aerial vehicle 20*a*, 20*b*, 20*c* . . . 20*n* so that the antenna 22 is pointed in the right direction to send the signal to hit the ground based target 21. The command and control signals C2 are generated at the command center 30, and are sent to the aerial vehicles 20*a*, 20*b*, 20*c* . . . 20*n* via wireless means. A command and control signal C2 signal is sent to the antenna control unit 24 of each aerial vehicle 20*a*, 20*b*, 20*c* . . . 20*n* to instruct the antenna 22 of the aerial vehicle 20*a*, 20*b*, 20*c* . . . 20*n* as to the precise latitude, longitude and altitude at which it is to direct its signal. The GPS 28 works in combination with the IRU 26 to send that information to the antenna control unit 24 which then transmits the signal on the correct phase to the specific ground based target 21.

Thus, with the present system, multiples aerial vehicles 20*a*, 20*b*, 20*c* . . . 20*n* accomplish the jamming that the mobile ground unit was doing beforehand. However, since aerial vehicles 20*a*, 20*b*, 20*c* . . . 20*n* are difficult to detect, the aerial vehicles 20*a*, 20*b*, 20*c* . . . 20*n* do not present a ready target for destruction. Even if some of the aerial vehicles 20*a*, 20*b*, 20*c* . . . 20*n* are destroyed, there may be enough aerial vehicles 20*a*, 20*b*, 20*c* . . . 20*n* remaining to produce an effective cellular jamming signal.

In use the ground based target 21 is flooded with signals at the cell phone frequency to deny legitimate signals from getting to their target, i.e. a cell phone to detonate a roadside bomb. The ground based target 21 is flooded with noise so that that the cell phone cannot determine what the proper signal is. With the present system, the smaller signals from the multiple aerial vehicles 20*a*, 20*b*, 20*c* . . . 20*n* are summed, and by summing these smaller signals using the phase alignment within the ground based target 21, a much more powerful signal is provided than any single antenna 22 would provide. The signals from all of the aerial vehicles 20*a*, 20*b*, 20*c* . . . 20*n* are added together such that their peak amplitudes align for that specific latitude and longitude ground based target 21.

The command center 30 instructs the aerial vehicles 20*a*, 20*b*, 20*c* . . . 20*n* to send the phase signals. Since all of the signals that the aerial vehicles 20*a*, 20*b*, 20*c* . . . 20*n* sent to the ground based target 21 are in phase, the ground based target 21 is flooded with a strong jamming signal. As the ground based target 21 moves, for example, as the convoy progresses down the road, the direction of the signals being sent from the aerial vehicles 20*a*, 20*b*, 20*c* . . . 20*n* is continuously adjusted to send new jamming signals directed at the new ground based target(s) 21.

The present system and method can be used in any country when cellular signs are present. The frequency of cell phone is dependent upon the country. Suitable antennas 22 are provided on the aerial vehicles 20*a*, 20*b*, 20*c* . . . 20*n* depending upon the country.

In the present system, the aerial vehicles 20*a*, 20*b*, 20*c* . . . 20*n* do not need to be in communication with each other. The command center 30 controls the actions of each aerial vehicles 20*a*, 20*b*, 20*c* . . . 20*n*. In some embodiments, the aerial vehicles 20*a*, 20*b*, 20*c* . . . 20*n* may be in communication with each other.

Aerial vehicles 20*a*, 20*b*, 20*c* . . . 20*n*, especially unmanned aerial vehicles, are small and difficult to target. Even if one aerial vehicle 20*a*, 20*b*, 20*c* . . . 20*n* is hit, then the other aerial vehicles 20*a*, 20*b*, 20*c* . . . 20*n* are still able to provide protection for that identified latitude, longitude and altitude of the ground based target 21 by sending signals.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. Accordingly, the invention is not to be restricted except in light of the appended claims and their equivalents.

The invention claimed is:

1. A system for jamming a cellular signal near a ground based target location comprising:

a plurality of aerial vehicles, wherein each of the plurality of aerial vehicles comprises:

an onboard antenna control unit, an antenna coupled with the onboard antenna control unit, and an onboard Inertial Reference Unit (IRU) configured to communicate with the onboard antenna control unit; and a command center configured to:

receive location and attitude data from each of the plurality of aerial vehicles, determine, based on the location and attitude data, individualized transmission characteristics and individualized attitude control data for each of the plurality of aerial vehicles, wherein the individualized attitude control data points the antennas of the plurality of aerial vehicles in a direction of the ground based target, and transmit the individualized transmission characteristics and the individualized attitude control data to the plurality of aerial vehicles, wherein each of the plurality of aerial vehicles is configured to:

transmit, based on the individualized transmission characteristics and the individualized attitude control data, via the antenna, a jammer signal to the ground based target to jam a cellular signal.

2. The system of claim 1, wherein the jammer signals sent to the ground based target are in phase.

3. The system of claim 2, wherein the jammer signals sent to the ground based target hit the ground based target at peak amplitude.

4. The system of claim 1, further comprising an onboard Global Positioning Unit (GPU) which is in communication with the IRU.

5. The system of claim 1, wherein the command center is remote from the aerial vehicles.

6. The system of claim 1, wherein the command center is ground-based.

7. The system of claim 1, wherein the command center is aerial-based.

8. The system of claim 1, wherein the aerial vehicles are unmanned aerial vehicles.

9. The system of claim 1, wherein the antenna is an ultra-high frequency (UHF) antenna.

10. The system of claim 1, wherein said ground based target is a convoy.

11. The system of claim 1, wherein the command center is configured to:

receive updated location and attitude data;

determine, based on the updated location and attitude data, adjusted individualized transmission characteristics; and transmit the adjusted individualized transmission characteristics.

12. The system of claim 1, wherein the IRU is configured to:

determine the location and attitude data, wherein the location and attitude data comprises a latitude, a longitude, and an altitude of the aerial vehicles within 1/50 of a wavelength of the jammer signal.

13. A method of jamming cellular signals comprising:

providing a plurality of aerial vehicles;

receiving, at a command center, location and attitude data signal from the plurality of aerial vehicles;

transmitting, by the command center, control signals based on the location and attitude data signals to the plurality of aerial vehicles, wherein the control signals comprise individualized attitude control data for each of the plurality of aerial vehicles, wherein the individualized attitude control data points respective antennas of the plurality of aerial vehicles in a direction of a ground based target; and transmitting a plurality of jammer signals from the plurality of aerial vehicles to the ground based target to jam a cellular signal at the ground based target, wherein the plurality of jammer signals are based on the control signals.

14. The method of claim 13, wherein the plurality of jammer signals are sent continuously from the plurality of aerial vehicles.

15. The method of claim 13, wherein the plurality of jammer signals are in-phase.

16. The method of claim 13, wherein the plurality of jammer signals hit the ground based target at peak amplitude.

17. The method of claim 13, wherein the ground based target is a convoy.

18. The method of claim 13, further comprising:

determining location and attitude data for each of the plurality of aerial vehicles, wherein the location and attitude data comprises a latitude, a longitude, and an altitude of each of the plurality of aerial vehicles within 1/50 of a wavelength of the plurality of jammer signals.

19. A method of jamming cellular signals comprising:

providing a plurality of aerial vehicles;

receiving, at a remote command center, aerial vehicle data from each of the plurality of aerial vehicles;

sending, based on the aerial vehicle data, a command signal to each of the plurality of aerial vehicles from the remote command center, wherein the command signals comprise individualized attitude control data for each of the plurality of aerial vehicles, wherein the individualized attitude control data points respective antennas of the plurality of aerial vehicles in a direction of a ground based target; and sending, based on the command signals, a plurality signals from the plurality of aerial vehicles to the ground based target, the signals are sent continuously from the plurality of aerial vehicles, the signals are in-phase, and the signals hit the ground based target at peak amplitude.

20. The method of claim 19, wherein the ground based target is a convoy.

* * * * *